US009569900B2

(12) United States Patent
Sharpe

(10) Patent No.: US 9,569,900 B2
(45) Date of Patent: Feb. 14, 2017

(54) TIMEPIECE WITH SECONDARY DISPLAY FOR SHOWING LOGGED EVENT TIMES

(71) Applicant: Ronald W. Sharpe, San Ysidro, CA (US)

(72) Inventor: Ronald W. Sharpe, San Ysidro, CA (US)

( * ) Notice: Subject to any disclaimer, the term of this patent is extended or adjusted under 35 U.S.C. 154(b) by 0 days.

(21) Appl. No.: 14/207,747

(22) Filed: Mar. 13, 2014

(65) Prior Publication Data

US 2014/0321245 A1 Oct. 30, 2014

Related U.S. Application Data

(60) Provisional application No. 61/815,578, filed on Apr. 24, 2013.

(51) Int. Cl.
*G04G 9/00* (2006.01)
*G04C 17/00* (2006.01)
*G07C 1/02* (2006.01)

(52) U.S. Cl.
CPC ..... *G07C 1/02* (2013.01); *G04C 17/0091* (2013.01); *G04G 9/00* (2013.01)

(58) Field of Classification Search
CPC ..... G04G 11/00; G04G 9/00; G06F 19/3406; A61J 7/0481; G04C 17/0091
USPC ..... 368/10, 107–109
See application file for complete search history.

(56) References Cited

U.S. PATENT DOCUMENTS 4,236,240 A * 11/1980 Yoshida ..... 368/76
4,505,595 A * 3/1985 Rose ..... G04F 10/04 368/110
4,797,864 A * 1/1989 Stano ..... G07C 1/22 368/107
4,831,605 A * 5/1989 Suga ..... 368/113
5,691,932 A * 11/1997 Reiner et al. ..... 368/10
6,301,196 B1 * 10/2001 Daniel ..... 368/10
7,522,477 B1 * 4/2009 Sheldon ..... G04F 1/005 368/10
7,710,834 B1 * 5/2010 Schrock et al. ..... 368/110
7,835,230 B1 * 11/2010 Chang ..... 368/109
8,260,405 B2 9/2012 Aarts
2005/0276165 A1 * 12/2005 Chien ..... 368/107
2008/0051667 A1 * 2/2008 Goldreich ..... 600/481
2008/0234600 A1 9/2008 Marsh
2009/0109798 A1 * 4/2009 West et al. ..... 368/10
2010/0061190 A1 * 3/2010 Nelson ..... 368/10
(Continued)

*Primary Examiner* — Vit W Miska

(74) *Attorney, Agent, or Firm* — Global Intellectual Property Agency, LLC; Daniel Boudwin

(57) ABSTRACT

A timepiece is presented that is adapted for recording the times of important events throughout the day. The timepiece comprises a primary display for viewing the current time of day and a secondary display for sequentially viewing one of a plurality times logged throughout the day corresponding with the important event. Interactive buttons on the timepiece facilitate the viewing and logging of the times displayed on the secondary display. A first button is a push button mechanism that records a time within the memory of the timepiece. A second button facilitates the scrolling of times on the secondary display for viewing by an individual. The timepiece can be utilized for recording the times of meaningful events throughout the day. For instance, the present invention may be utilized for recording how often a loved one is thought of or for when medication was last taken.

10 Claims, 4 Drawing Sheets

(56) References Cited

U.S. PATENT DOCUMENTS

Figure 1:
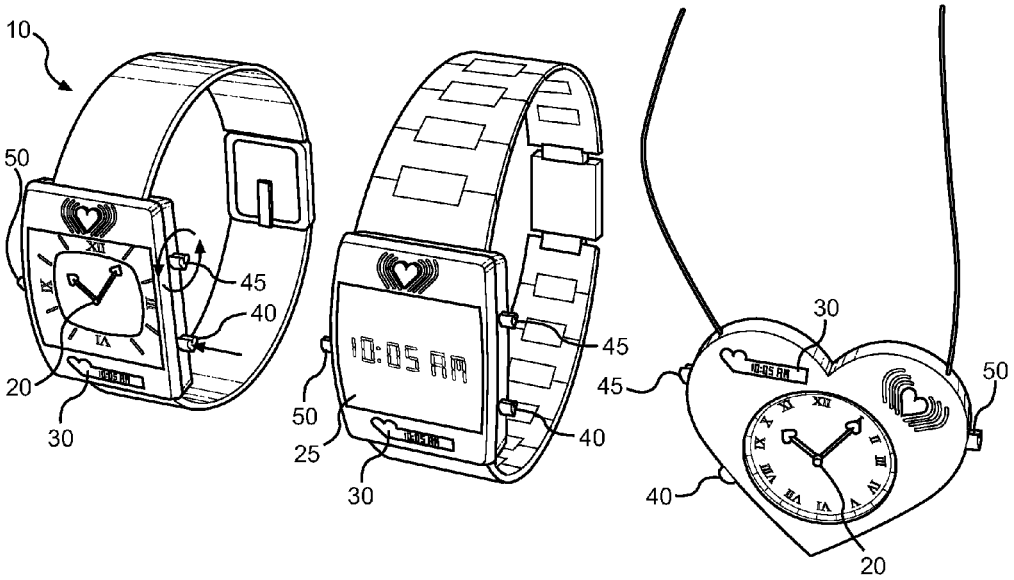

| | | | | |
|---|---|---|---|---|
| 2010/0311544 | A1 | 12/2010 | Robinette et al. | |
| 2012/0277014 | A1 | 11/2012 | Caldwell | |
| 2013/0329530 | A1* | 12/2013 | Johansson | 368/29 |

* cited by examiner

TIMEPIECE WITH SECONDARY DISPLAY FOR SHOWING LOGGED EVENT TIMES

CROSS REFERENCE TO RELATED APPLICATION

This application claims the benefit of U.S. Provisional Application No. 61/815,578 filed on Apr. 24, 2013. The above identified patent application is herein incorporated by reference in its entirety to provide continuity of disclosure.

BACKGROUND OF THE INVENTION

Field of the Invention

The present invention relates to a device for recording the times throughout the day in which a memorable event occurs. More specifically, the present invention relates to a timepiece that includes a first display for observing the current time and a second display for viewing a series of logged times corresponding to a specific event.

Watches, clocks, and other timepieces have been used in the past for keeping a constant record of time throughout the day. Over the years the traditional watch has evolved to include the ability to record and keep track of supplemental data. Current watches are capable of keeping a record of the seconds, hours, days, weeks, and months of a given calendar year. Some specialized watches are also adapted for use in keeping data for fitness or can comprise a means for recording the speed of cars, boats, and/or planes. These features and more can be incorporated into analog and digital watches in order to provide different functionality to suit the needs of an individual.

While the known watch varieties each can comprise features that fit certain needs, there lacks a sufficient means marking the times that important events happen during a given day. Most watches include an audible or vibratory alarm that serves as a reminder to an individual that a task must be completed, such as waking up or taking medication. These alarms, however, fail to provide a means for reminding an individual if an event has occurred. For example, if an individual has previously taken their medication but has forgotten when, there does not exist a timepiece that comprises a means for recording a plurality of individual times for reviewing at a later time.

The present invention, however, provides a timepiece that comprises a means for recording instances in which important events occur throughout the day. The present invention enables an individual to press a button on the timepiece in order to timestamp a moment in time corresponding to a given event, thereby providing the individual with a log or series of references that correspond to the event occurrence over a specified period. The timepiece logging button can serve as a reference point for, inter alia, how often a loved one is thought of, a reminder for when medication was last taken, or may serve as a mechanism that indicates when an event has begun or ended.

Description of the Prior Art

Devices have been disclosed in the prior art that relate to timepieces. These include devices that have been patented and published in patent application publications. These devices generally relate to watches that include specialized additions that are directed for supplying data that relates to sports parameters. The following is a list of devices deemed most relevant to the present disclosure, which are herein described for the purposes of highlighting and differentiating the unique aspects of the present invention, and further highlighting the drawbacks existing in the prior art.

One such prior art device, U.S. Patent Publication No. 2010/0311544 to Robinette provides a wristband assembly having an opening for receiving a USB-type device therein. The connectable device includes a means for recording the distance traversed by an athlete while wearing the device. While the prior art device is suitable for its own purposes, it fails to provide a means for enabling an individual to timestamp any of a variety of important occurrences throughout the day.

Another prior art device, U.S. Patent Publication No. 2012/0277014 to Caldwell provides an athletic monitoring watch. The watch includes a wrist strap, memory, an accelerometer, and a sensor that responds to movements of the wrist. The components of the prior art device are configured to provide a training device for improving golf swings. The prior art device utilizes audible and/or visual alarms that alerts the golfer to an event, such as an improper swing that departs from previous swings that are stored in the memory of the watch. Although the prior art device provides an alarm that signifies an event in time, the prior art device fails to provide a timestamp that is manually determined by the user.

Yet another prior art device, U.S. Pat. No. 8,260,405 to Aarts provides a monitoring apparatus for tracking the heart rate of an individual. The device includes a wrist strap, a capacitor, and a data processor for determining the heart rate and/or heart rate variation based on changes in the capacitance of the capacitor. The device further comprises an alarm that is generated when it is determined that the heart rate is out of a predetermined range that is stored in memory. Another device, Patent Publication No. 2008/0051667 to Goldreich provides a wrist-worn device adapted for measuring physiological parameters, including that of heart rate, blood pressure, breathing rate, body temperature and other parameters. When the parameters pass a predetermined threshold an alarm is signaled that indicates an emergency situation. Alternatively, the individual may press a panic button on the device when an adverse situation arises. While the prior art comprises a means of recording and comparing events in time, the prior art fails to provide a user controlled time reference for a passed event as a reminder for what has happened previously in the day.

Finally, U.S. Patent Publication No. 2008/0234600 to March provides a hydration monitor that includes a temperature sensor for measuring body temperature. A processor receives signals from the sensor and then compare the received signals and signal an alarm if the signals are outside of safe parameters. While the device of the prior art is similar in nature and relevant to the present invention, it fails to provide a manually actuated button that is adapted for recording a time of day.

The present invention provides a timepiece that is utilized for providing a timestamp for making note of one or more events during a day. These events can be related to how often you think of someone or something and/or as a reference of when a task or goal has been completed. The timepiece can comprise the form of a watch, pendant, or clock, whereby each of the timepiece designs include a primary and a secondary display. The primary display resembles the traditional display of timepieces, and can include analog or digital time display mechanisms, whereas the secondary display comprises a digital display. The present invention includes three user control buttons that are adapted for setting the time of the device and for recording and displaying a plurality of times throughout the day. A first button is a push actuated button that records a time within the memory of the present invention when the button is pressed. Thereafter, the second button may be turned in order to facilitate the scrolling through the times that were previously recorded. Finally, a crown may be actuated in order to set the time on the digital or analog display of the timepiece.

In view of the drawbacks of the prior art devices, it is shown that the prior art has several known setbacks and that the present invention is substantially divergent in design elements from the prior art and subsequently it is clear that there is a need in the art for an improvement to existing timepieces. In this regard the instant invention substantially fulfills these needs.

SUMMARY OF THE INVENTION

In view of the foregoing disadvantages inherent in the known types of specialized timepieces now present in the prior art, the present invention provides a new timepiece wherein the same can be utilized for providing convenience for the user when desiring to provide a timestamp for events during a day.

It is therefore an object of the present invention to provide a new and improved timepiece that has all of the advantages of the prior art and none of the disadvantages.

It is another object of the present invention to provide a timepiece that comprises a means for recording the time at which an event occurs.

Another object of the present invention is to provide a timepiece that comprises a primary display for viewing the current time and a secondary display for viewing a previously recorded time.

Yet another object of the present invention is to provide a means for scrolling through a plurality of recorded times.

Finally, it is another object of the present invention to provide a means for transferring the plurality of recorded times to another device.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a view of different designs of the timepiece of the present invention.

Figure 2:
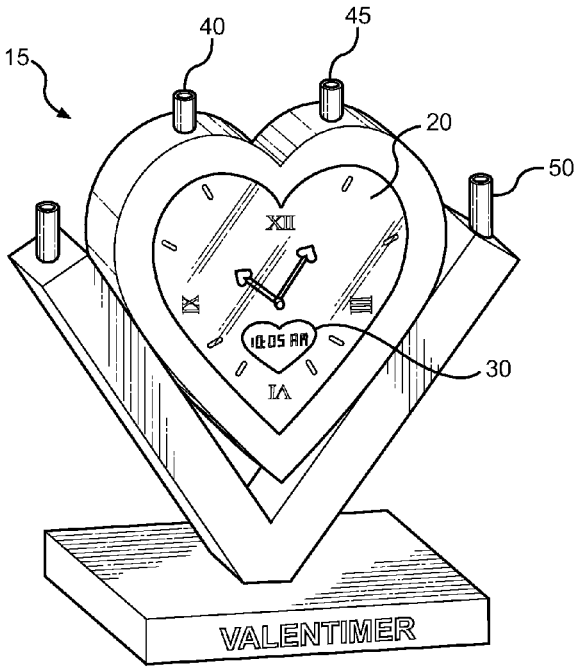

FIG. 2 displays a view of the timepiece of the present invention incorporated into a clock design.

Figure 3:
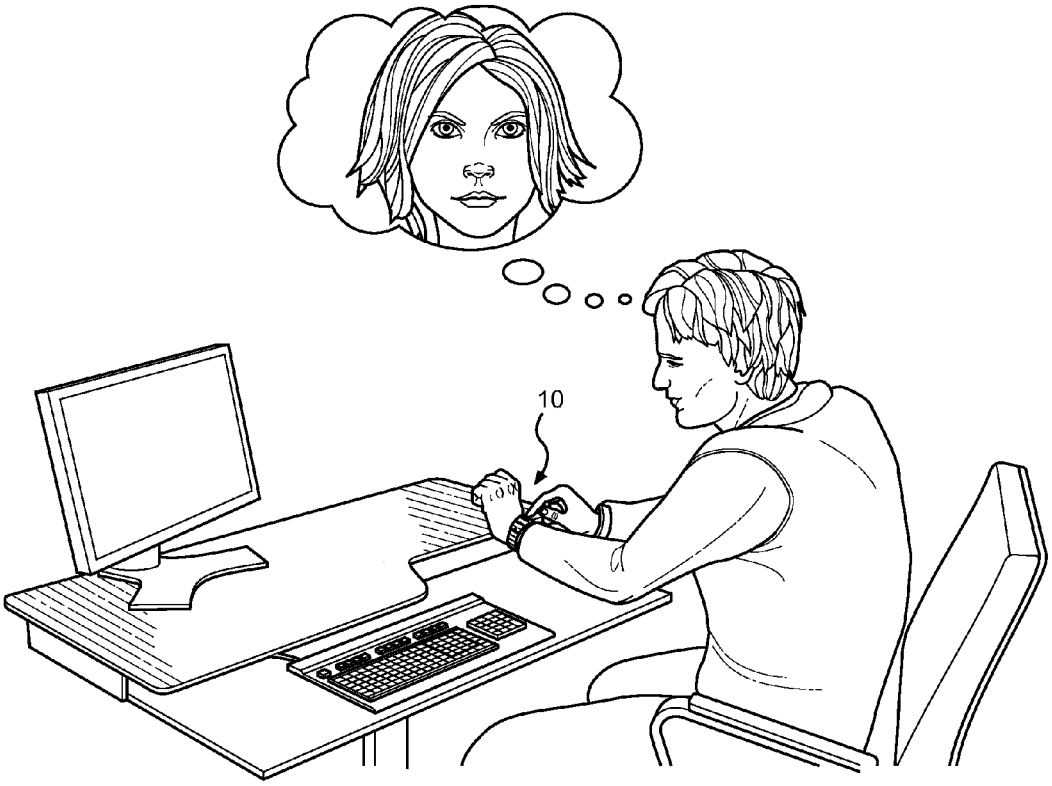

FIG. 3 displays a view of an individual pressing a button on the timepiece to record times.

Figure 4:
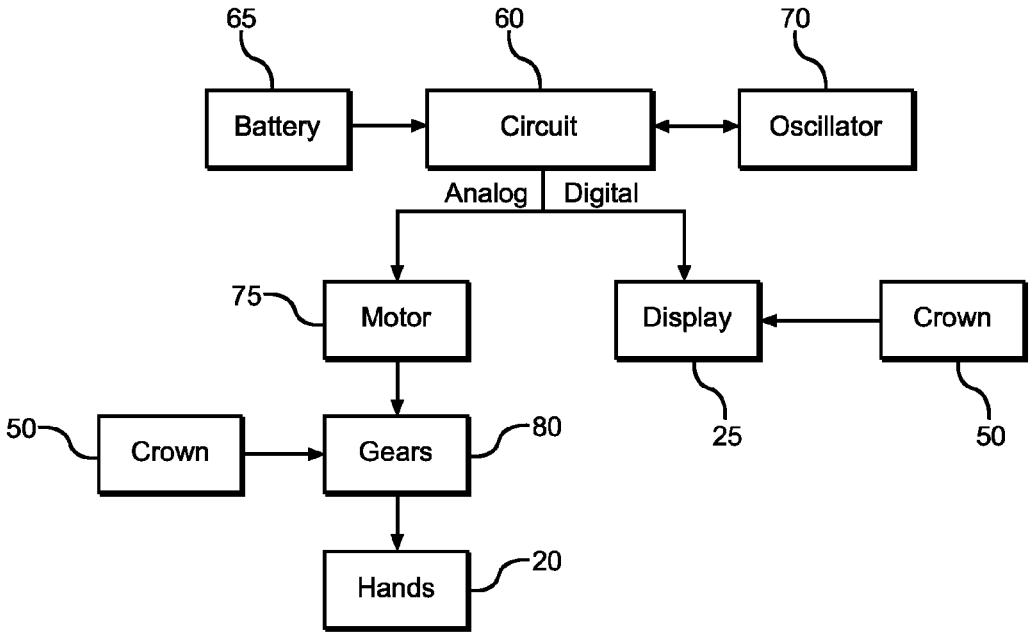

FIG. 4 displays a flowchart of the operation of the primary display.

Figure 5:
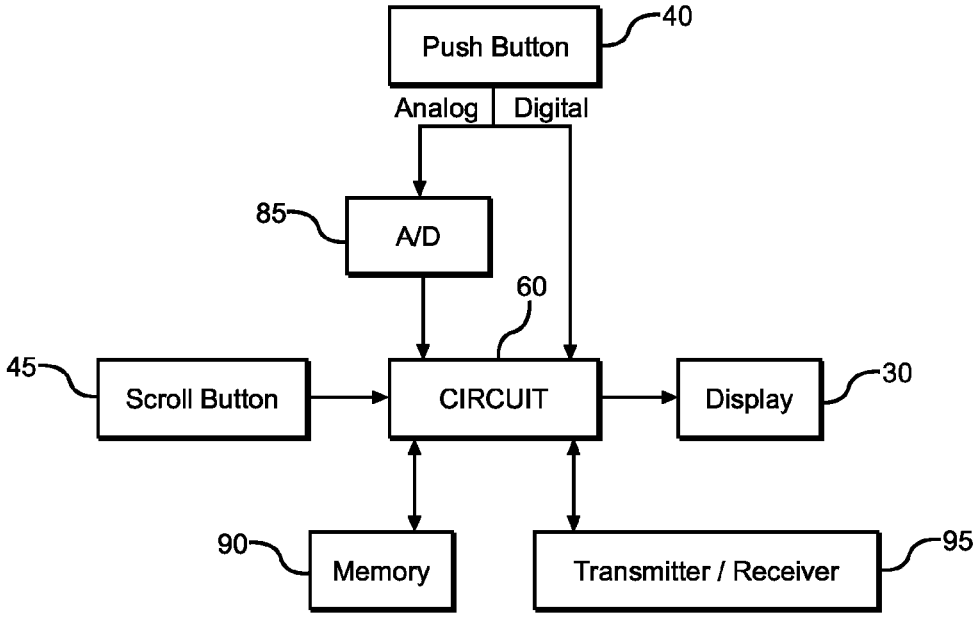

FIG. 5 displays a flowchart of the operation of the secondary display.

Figure 6A:
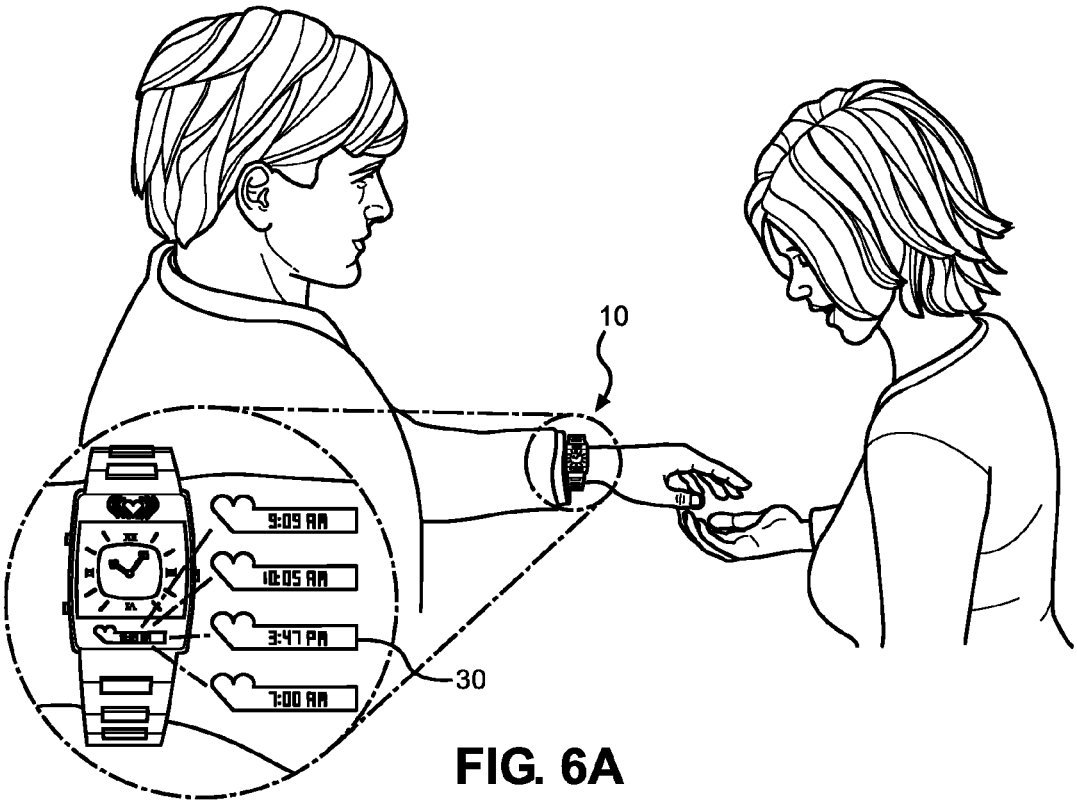

FIG. 6A displays a view of an individual displaying the plurality of recorded times another individual.

Figure 6B:
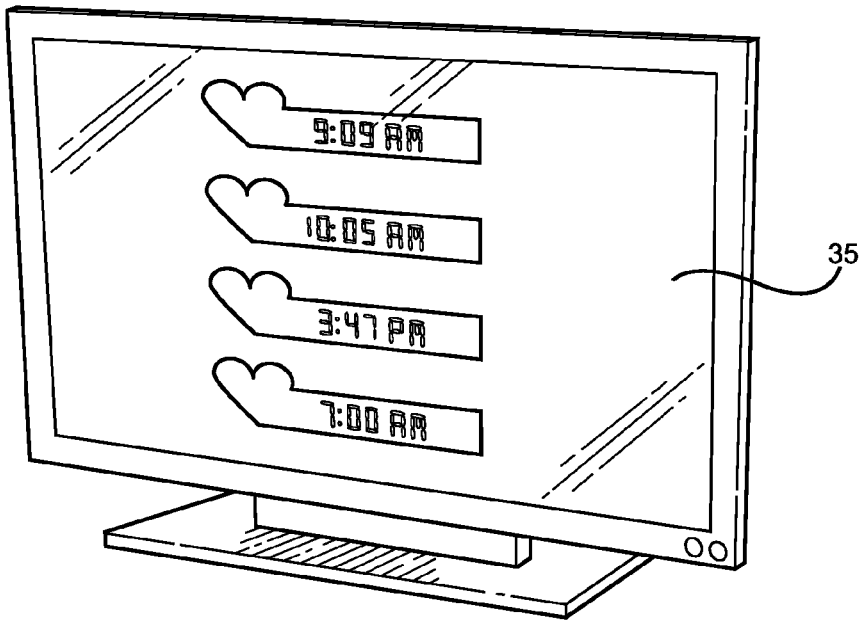

FIG. 6B displays a view of the plurality of recorded times on a secondary device.

DETAILED DESCRIPTION OF THE INVENTION

Reference is made herein to the attached drawings. Like reference numerals are used throughout the drawings to depict like or similar elements of the wristwatch. For the purposes of presenting a brief and clear description of the present invention, the preferred embodiment will be discussed as used for recording meaningful events. The figures are intended for representative purposes only and should not be considered to be limiting in any respect.

Referring now to FIGS. 1 and 2, there is a displayed a view of different designs of the timepiece of the present invention and a view of the timepiece of the present invention incorporated into a clock. A timepiece 10 is presented that is adapted for providing a recording in the form of timestamps of events that have occurred throughout a day. These timestamps are of convenience for those who desire to remember the exact time at which events have happened. An individual can use the present invention for displaying affection by recording when a loved one is thought of, can be used for remembering when medication was last taken, and can be utilized for recording the time at which a task has begun or was completed.

The device of the present invention is adapted to be incorporated into on different timepiece embodiments, such as wristwatches, pocket watches, pendants, and clocks, whereby each of the embodiments include primary and secondary displays. The primary display 20, 25 comprises the traditional timepiece display that occupies the majority of the display face of watches, clocks 15, and the like. The primary display can comprise the watch hands of an analog timepiece 20, or may comprise an illuminated digital means 25 of displaying the current time of day to an individual. The secondary display 30 is adapted for displaying sequentially displaying one of a plurality of timestamps that are logged within the memory of the timepiece by the user.

The timepiece also comprises three user control buttons that are utilized for controlling the functions of the primary and secondary displays. The watch hands 20 or digital display 25 of the primary screen is controlled by a traditional style crown actuated knob 50 that may be pushed, pulled, or twisted in order to manually change the primary display time on the timepiece of the present invention.

The user control buttons on the opposing side of the crown 50 are utilized for controlling the functions of the secondary display 30. A first secondary display control button 40 is adapted for recording one or more times a time at which meaningful events occur. These moments can include events such as thinking of a loved one, recording the time of a child's first steps or speech, the time of when medicine is taken, and more. The first button 40 for controlling the secondary screen 30 is a time logging push activated button. A depression of the button creates a timestamp of the current time that is displayed on the primary screen. Thereafter, the timestamp is stored within the internal memory of the watch and the most recent recorded time is displayed on the secondary screen 30.

The second button for controlling the secondary screen is a timestamp scrolling button 45 that is adapted for facilitating the sequential viewing of each of the previously recorded timestamps, whereby a timestamp is recorded into the memory of the timepiece after each depression of the first control button. The second control button can be rotated forwards and/or backwards in order to access the memory of the timepiece and scroll through each of the logged timestamps that are displayed on the secondary screen 30.

Referring now to FIG. 3, there is displayed a view of an individual pressing the first control button on the timepiece of the present invention. The present invention 10 is designed for enabling an individual to record the times that events occur throughout the day. The device may be used as a means for showing how often a loved one is on your mind, as well as a general reminder of the exact times when tasks are completed or have begun. For example, an individual may press the push actuated time recording button after each moment of thinking about a significant other and those times may be replayed for viewing at a later time. In another example, the button may be depressed in order to record when medication was taken, thereby eliminating the likelihood of a repeated dose of medication.

Referring now to FIG. 4, there is displayed a flowchart of the operation of the primary display of the present invention. The timepiece of the present invention comprises a plurality of internal components that govern the functionality of the primary display. At the center of the components is electric circuit 60 that facilitates communication between the remaining components. The circuit 60 may include a processor, a printed control board, and wired connections for operationally connecting the electrical components of the timepiece. A power source 65 comprises a battery or outlet power (in the case of a stationary clock embodiment) provides power to drive the circuit 60 and the operational elements of the timepiece clock itself. If an analog watch is deployed, power is transferred to mechanical assemblies within the timepiece to advance the clock hands. In one embodiment, a tuning fork-shaped oscillator 70 is provided that vibrates at a set rate. The circuitry 60 detects the number of vibrations of the oscillator 70 and generates regular electronic pulses at a rate of one per second. With an analog timepiece, the one-second pulses are utilized for driving a small motor 75, thereby converting the electrical energy into mechanical power that turns gears 80 that rotate the hands on the primary display 20 of the analog timepiece in a traditional manner. Alternatively, with a digital timepiece the circuitry 60 directly operates the updating of the primary display 25, which can be an LCD display or other display that provides updating numerical time display. For each, a crown 50 is provided for actuating the hands 20 or the numerical display 25 on the analog or digital primary displays.

Referring now to FIG. 5, there is displayed a flowchart of the operational elements of the secondary display 30. The aforementioned internal circuitry 60 is further configured for controlling the secondary screen 30, whereby the circuitry 60 communicates with the time logging push button mechanism 40, analog/digital converter 85 (with Analog timepiece), a timestamp scrolling button 45, memory 90, and a transmitter/receiver 95. On an analog timepiece the depression of the push button 40 sends a signal that represents the time displayed on the primary display to the A/D converter 85, which then sends a digital representation of the current time to the circuit 60. Alternatively, in the digital timepiece the push button 40 communicates directly with the circuit 60. After the circuitry receives the time from the depression of the push button 40, the circuitry records the timestamp in the internal memory 90 of the timepiece and displays the most current timestamp recorded on the secondary screen for viewing 30. A timestamp scrolling button 45 is provided in order to facilitate the viewing of previously recorded times. When the scroll button 45 is rotated forward or backwards the circuitry 60 accesses the plurality of timestamps stored within the memory 90 of the timepiece. Each turn or partial turn facilitates the sequential displaying of the timestamps on the secondary display 30 in order to enable viewing by an individual. Further, the present invention comprises a transmitter/receiver 95 that enables the plurality of timestamps stored in the memory 90 of the device to be transmitted to a secondary device via a wired or wireless connection. These devices may be a similar watch, a computer, laptop, tablet computer, and/or a cellular device.

Referring now to FIGS. 6A and 6B, there is displayed a view of an individual displaying the plurality of recorded times to a loved one and a view of the plurality of recorded times on an external device. Actuation of the scrolling button enables an individual to review and/or show the plurality of logged timestamps. Reviewing the plurality of times on the secondary display serves as a means for remembering the times that important events had occurred during the day. For example, the plurality of times may be used for showing a loved one how often you think of them or for remembering a task that has been completed previously, such as taking medicine. As shown in FIG. 6B, the plurality of logged timestamps stored in memory can be wired or wirelessly transferred to a secondary device 35 for viewing a plurality of timestamps at once.

The present invention provides a timekeeping device that can be incorporated into both analog and digital timepieces, whereby the timepiece can be a watch, clock, pendant, or similar timekeeping device. The device comprises a primary screen, which can display the current time in analog 20 or digital formats 25, and a secondary screen 30 that is adapted for displaying a recorded time thereon. The timepiece comprises a time setting crown 50 that is adapted for setting the time on the primary display and a pair of buttons for controlling the secondary display 30. A time logging push button 40 provides a depression actuated means for changing the displayed time on the second screen 30, whereby the depression of the button sends a signal to the internal circuitry of the timepiece to the current time on the primary display 20, 25 and display the time on the secondary display 30. Thereafter, a timestamp scrolling button 45 for controlling the secondary display 30 is rotated in order to facilitate the sequential viewing of the plurality of meaningful events times that are recorded and stored within the internal memory 90 of the timepiece.

The memory 90 of the timepiece 10 can be sized to store a plurality of timestamps, however, it may be desirable to delete unnecessary time logs. The present invention can comprise a means for deleting the timestamps. For example, the currently displayed time can be deleted by depressing the time logging push button 40 for a few seconds. It is further contemplated that the timestamps can be deleted automatically. This can be accomplished by programming the circuitry 60 to delete the oldest timestamps once a predetermined number of timestamps has been record. Alternatively, the timestamps can be reset after a certain time span is surpassed, for example, a day. The present invention provides a benefit for individuals who desire to remember the times at which important events occur throughout their days. These timestamps can be added and/or removed as desired in order to provide an accurate logging for viewing at a later time on the timepiece or on a secondary device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A timepiece for recording times when an event occurs, comprising:

a primary display, a secondary display, and an electric circuit comprising a memory operatively coupled to said primary display and said secondary display;

wherein said timepiece is an analog timepiece and said primary display is a mechanical watch face having movable hands indicating a time of day;

a power source; said primary display being adapted to display a time; a first control adapted to initiate storage of the time as one or more user logged times within the memory;

a second control adapted to successively and individually display each of the one or more user logged times on the secondary display;

wherein the primary display and the secondary display are distinct from each other and configured to simultaneously present the time and the one or more user logged times.

2. The device of claim 1, wherein the second control comprises a time logging button and a timestamp scrolling button.

3. The device of claim 2, wherein said time logging button is a push button mechanism, and wherein actuation of said time logging button records the time displayed on said primary display in said memory for display on said secondary screen.

4. The device of claim 2, wherein said timestamp scrolling button is a twist-rotatable button, and wherein actuation of said scrolling button facilitates the sequential display of a plurality of recorded times on said secondary display.

5. The device of claim 1, wherein said timepiece further comprises a receiver/transmitter for viewing the one or more user logged times on a secondary device.

6. The device of claim 1, wherein said timepiece is a pendant.

7. The device of claim 1, wherein said timepiece is a watch.

8. The device of claim 1, wherein said timepiece is a clock.

9. The device of claim 1, wherein said timepiece is a digital timepiece and said primary display is a digital display indicating time.

10. The device of claim 1, wherein the secondary display is configured to individually display each of the one or more user logged times.

* * * * *